US009808055B1

(12) United States Patent
Cipolla

(10) Patent No.: US 9,808,055 B1
(45) Date of Patent: Nov. 7, 2017

(54) JEWELRY SETTING

(71) Applicant: Steven A. Cipolla, Warwick, RI (US)

(72) Inventor: Steven A. Cipolla, Warwick, RI (US)

(73) Assignee: National Chain Company, Warwick, RI (US)

( * ) Notice: Subject to any disclaimer, the term of this patent is extended or adjusted under 35 U.S.C. 154(b) by 346 days.

(21) Appl. No.: 14/601,614

(22) Filed: Jan. 21, 2015

(51) Int. Cl.
*A44C 17/02* (2006.01)

(52) U.S. Cl.
CPC ..... *A44C 17/02* (2013.01)

(58) Field of Classification Search
CPC ..... A44C 17/02; A44C 17/00208; A44C 17/0216; A44C 17/0225
USPC ..... 63/26, 27; D11/91, 92
See application file for complete search history.

(56) References Cited

U.S. PATENT DOCUMENTS 717,824 A * 1/1903 Dover ..... A44C 17/02 63/27
729,606 A * 6/1903 King ..... A44C 17/02 63/27
2,069,598 A * 2/1937 Arpels ..... A44C 17/02 63/26
4,781,038 A * 11/1988 Branca ..... A44C 11/007 59/80
D509,766 S * 9/2005 Aghjayan ..... D11/91
2006/0101747 A1* 5/2006 Masukawa ..... C04B 35/62625 52/302.1

* cited by examiner

*Primary Examiner* — Jack W Lavinder
(74) *Attorney, Agent, or Firm* — Salter & Michaelson

(57) ABSTRACT

A jewelry snap setting for supporting a jewel and that includes a one-piece support member having a base portion having multiple sides and a plurality of elongated prongs with one extending from each respective side of the base portion. Each elongated prong includes contiguous respective proximal biasing and distal retaining portions. Each proximal biasing portion extends integrally from a respective side of the base portion, and at least said proximal biasing portion has an arcuate cross-section in a direction that is transverse to the longitudinal axis of the proximal biasing portion.

15 Claims, 5 Drawing Sheets

JEWELRY SETTING

FIELD OF THE INVENTION

The present invention relates in general to a jewelry setting and pertains, more particularly, to an improved jewelry setting that is characterized by an enhanced gripping force while at the same time being relatively lightweight.

BACKGROUND OF THE INVENTION

There are a variety of different setting for jewels and stones. However, some of these settings are unnecessarily large or unnecessarily heavier in weight than should be necessary. Accordingly, it is an object of the present invention to provide a lightweight snap setting for stones, gems or the like items.

Existing settings are typically constructed of a metal material and include one or more supporting prongs. In this regard, another object of the present invention is to provide a lightweight setting in which the thickness of the prong can be made thinner than in existing prong structures. In this way, there is a considerable saving in the construction of the setting.

A further object of the present invention is to provide an improved setting that is preferably light in weight and which, although lightweight, has a strength at least equal to that of a much thicker prong construction.

Still another object of the present invention is to provide an improved setting in which the prong construction has a curvature that preferably runs the length of the prong. This is in comparison to existing settings that have flat prongs and ones that are much thicker in order to provide the desired rigidity and memory.

SUMMARY OF THE INVENTION

To accomplish the foregoing and other objects, features and advantages of the present invention there is provided a jewelry snap setting for supporting a jewel. The setting is comprised of a one-piece support member that includes a base portion having multiple sides, and a plurality of elongated prongs with one extending from each respective side of the base portion. Each elongated prong includes contiguous respective proximal biasing and distal retaining portions; Each proximal biasing portion extends integrally from a respective side of the base portion, and each contiguous retaining portion has a longitudinal axis that extends at an angle to a longitudinal axis of the biasing portion.

In accordance with other aspects of the present invention the angle between the respective longitudinal axes is an obtuse angle; at least the proximal biasing portion has an arcuate cross-section in a direction that is transverse to the longitudinal axis of the proximal biasing portion; there is a transverse arcuate cross-section through both the proximal biasing and distal retaining portions; each prong also includes an intermediate transition portion contiguous with and disposed between the respective biasing and retaining portions; the entire length of the prong has a transverse arcuate cross-section; the intermediate transition portion has an arcuate cross-section in a direction in line with the longitudinal axis of the proximal biasing portion; the intermediate transition portion also has an arcuate cross-section in a direction transverse to the proximal biasing portion; the distal retaining portion also has an arcuate cross-section in a direction that is transverse to the longitudinal axis of the distal retaining portion; the arcuate cross-section is defined by a radius of curvature having a center disposed within a footprint of the prongs; the proximal biasing portion has a length greater than a length of the distal retaining portion; and a width of each prong portion is less than a length of a respective prong portion.

In accordance with another version of the present invention there is also provided a jewelry snap setting for supporting a jewel. The setting comprises a one-piece support member that includes a base portion having multiple sides, and a plurality of elongated prongs with one extending from each respective side of the base portion. Each elongated prong includes contiguous respective proximal biasing and distal retaining portions. Each proximal biasing portion extends integrally from a respective side of the base portion. At least the proximal biasing portion has an arcuate cross-section in a direction that is transverse to the longitudinal axis of the proximal biasing portion.

In accordance with other aspects of the present invention each contiguous retaining portion has a longitudinal axis that extends at an angle to a longitudinal axis of the biasing portion; the angle between the respective longitudinal axes is an obtuse angle; there is a transverse arcuate cross-section through both the proximal biasing and distal retaining portions; each prong also includes an intermediate transition portion contiguous with and disposed between the respective biasing and retaining portions; the entire length of each prong has a transverse arcuate cross-section; the intermediate transition portion has an arcuate cross-section in a direction in line with the longitudinal axis of the proximal biasing portion; and the intermediate transition portion also has an arcuate cross-section in a direction transverse to the proximal biasing portion.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 6:
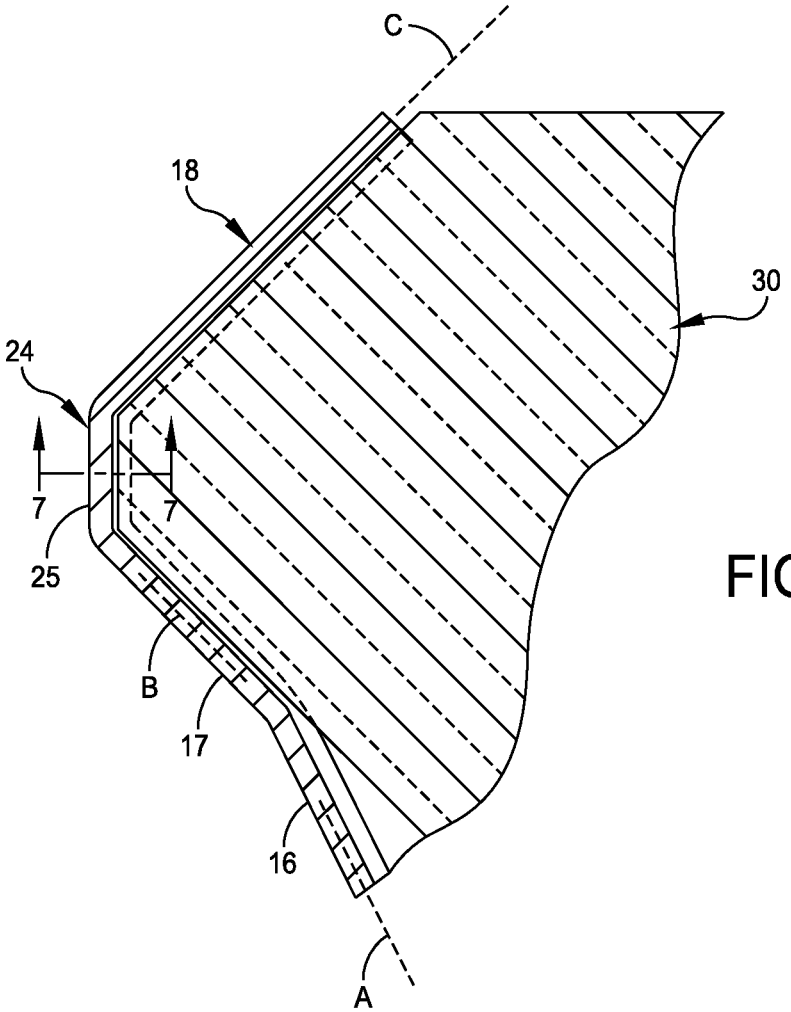
FIG. 6 is an enlarged fragmentary view similar to that illustrated in FIG. 2A but for an alternate prong construction.
Figure 7:
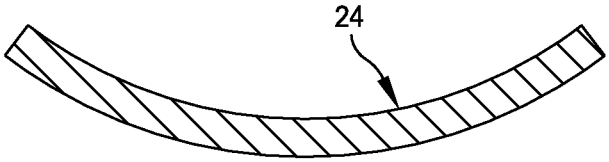
FIG. 7 is a cross-sectional view taken along line 7-7 of FIG. 6.
Figure 8:
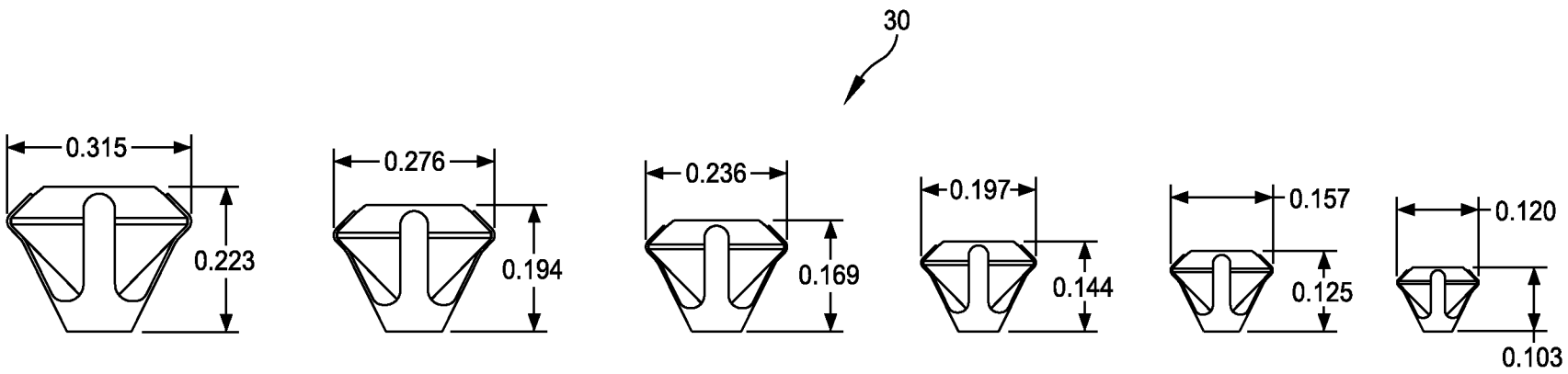
FIG. 8 shows various sizes of the setting that may be used in accordance with the present invention.

Reference is now made to the drawings for embodiments of the present invention. There are illustrated herein two separate embodiments that are quite similar in construction. The first embodiment is illustrated in FIGS. 1-5 and the second embodiment is illustrated in FIGS. 6 and 7. FIG. 8 illustrates various setting sizes that may be employed in accordance with the principles of the present invention. In FIG. 8 the dimensions are in fractions of an inch. In both of these embodiments, for the most part, the prong construction is identical and the variation relates primarily to a different intermediate transition portion shown in FIG. 2A at 20 and in FIG. 6 at 24. One of the important concepts of the present invention is the ability to provide a rigid setting that has relatively substantial strength while at the same time constructing a setting that is relatively lightweight. This is accomplished to a great extent by providing a curved prong such as illustrated in particular in the cross-sectional views shown in FIGS. 3-5. This curvature preferably extends the complete length of each prong. This curvature along with the particular configuration of each prong provides enhanced rigidity and retention memory.

Figure 1:
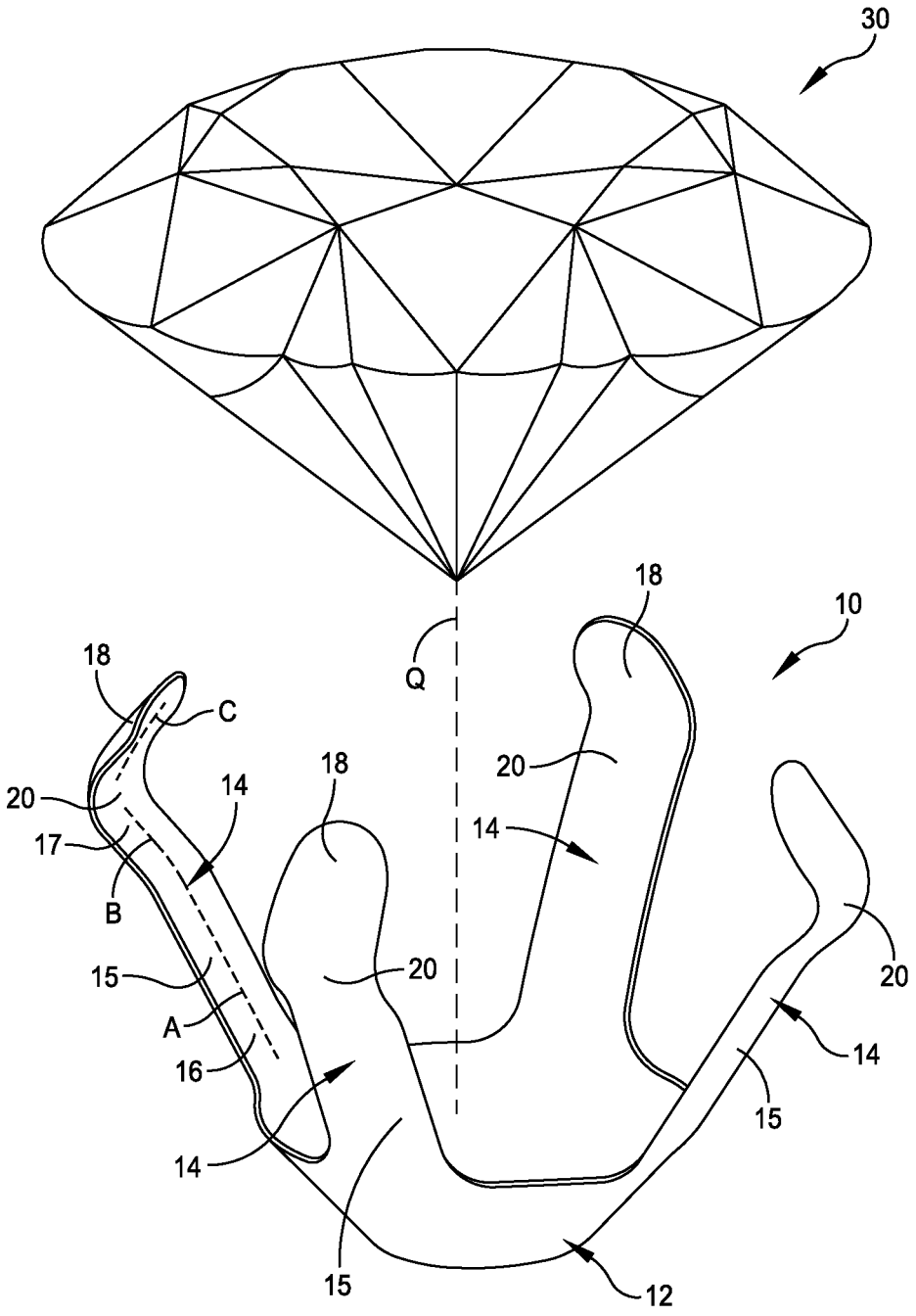
FIG. 1 is a perspective view of one embodiment of the setting of the present invention.

With reference to FIGS. 1-5, there is illustrated a snap setting 10 for supporting a jewel or stone 30. For clarity, in FIG. 1 the jewel or stone 30 is shown exploded away from the setting. The fragmentary enlarged view of FIG. 2A illustrates the jewel or stone 30 as held by the setting. The setting is a one-piece support member that includes a base portion 12 that may be considered as having multiple sides. There is also provided a plurality of elongated prongs 14 with one extending from each respective side of the base portion 12. As illustrated in FIG. 1, these prongs 14 number four and are disposed in diametrically opposed positions spaced essentially 90 degrees apart. Each of these prongs is integrally formed from the base portion 12. Each of the elongated prongs include contiguous respective proximal biasing and distal retaining portions. FIG. 1 illustrates the proximal biasing portion at 15 and the distal retaining portion at 18.

Figure 2:
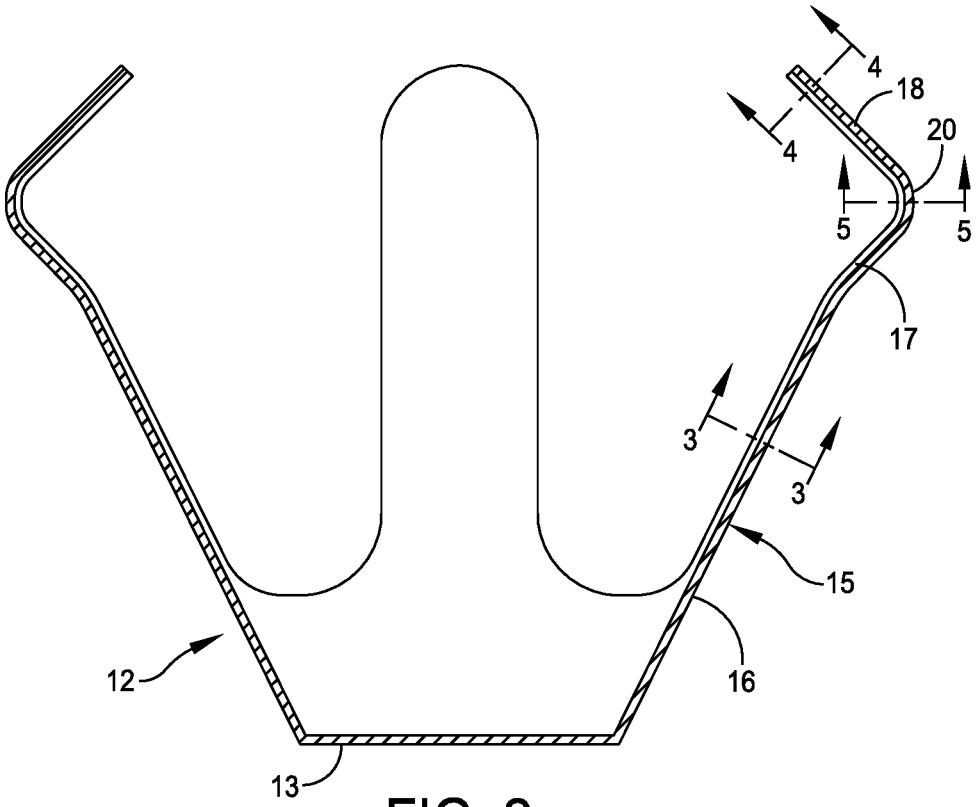
FIG. 2 is a cross-sectional view through opposed prongs.
Figure 2A:
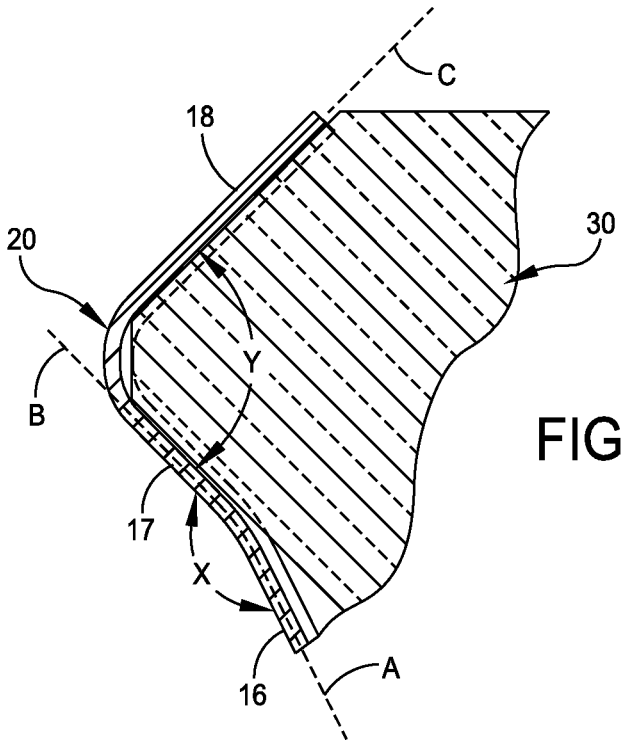
FIG. 2A is an enlarged fragmentary view with the stone or jewel in place.

Refer also to the cross-sectional views of FIGS. 2 and 2A. These cross-sectional views illustrate the biasing portion 15 and the retaining portion 18. Also illustrated, particularly in FIG. 2 is an axis A related to a part of the biasing portion 15 and a longitudinal axis C related to the retaining portion 18. This defines an angle Y in which the stone or jewel is retained.

With further reference to FIGS. 2 and 2A each prong also includes an intermediate transition portion 20 contiguous with and disposed between the respective biasing and retaining portions.

Figure 3:
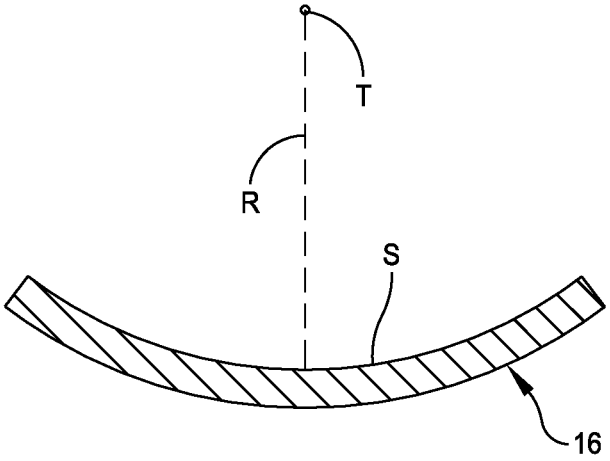
FIG. 3 is a cross-sectional view taken along line 3-3 of FIG. 2.
Figure 4:
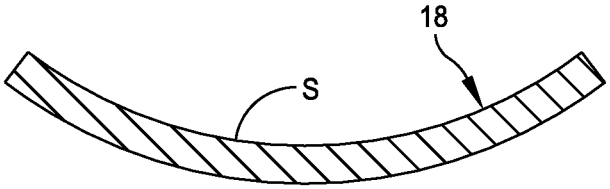
FIG. 4 is a cross-sectional view taken along line 4-4 of FIG. 2.
Figure 5:
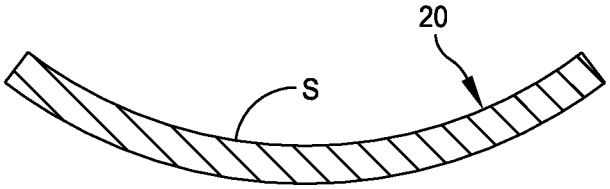
FIG. 5 is a cross-sectional view taken along line 5-5 of FIG. 2.

Reference is now also made to the cross-sectional views shown in FIGS. 3-5. These are cross-sections taken respectively at the biasing portion, retaining portion and transition portion. As shown in FIGS. 3-5, each of these has a curvature S. Because these prongs are usually of the same width, such as illustrated in FIG. 2, these curvatures S are usually of the same radius. This radius is illustrated in FIG. 3 by the line R emanating from a center point of rotation shown at T. Each of these curvatures provide a concave structure with the concavity directed inward toward a center point along an axis Q. Thus, this curvature is preferably continuous extending along the full length of each prong from the base portion 12, through the biasing portion 15, the intermediate portion 20 and in to the retaining portion 18. As indicated previously, this arcuate cross section is defined by a radius of curvature S having a center T that is essentially disposed within the footprint of the setting between all prongs. This curvature may be established by means of a single center point or multiple center points associated with each of the prongs.

FIGS. 2 and 2A also illustrate a particular configuration for the biasing portion 15 which includes a longer portion 16 and a shorter portion 17 extending about respective longitudinal axis A and B. The fragmentary cross-sectional view of FIG. 2A shows the axes A and B and an obtuse angle X that is disposed between the longer portion 16 and the shorter length portion 17. FIG. 2 also illustrates the base portion 12 as preferably having a flat bottom surface 13. In FIG. 2 each of the various portions 16, 17, 18 and 20 are formed in a continuous single prong structure such as illustrated in FIG. 1. It is also noted that in the first embodiment in FIGS. 1-5 in the intermediate transition portion 20 also has a curvature as illustrated in FIG. 2A at 20. Thus, at this transition portion there are essentially orthogonal curvatures. FIG. 2A shows one of the curvatures. The orthogonal curvature would be in and out of the paper of FIG. 2A and of a curvature similar to that shown in FIG. 5.

The improved configuration of the setting of the present invention is characterized by the curved prong construction as well as the provision for a longer length portion 16 and a shorter length portion 17 having an angle X therebetween that is obtuse and less than 180 degrees. This provides some additional biasing force as the jewel or stone is retained. The angle Y shown in FIG. 2 between portion 17 and portion 18 may be on the order of 90 degrees.

Reference is now made to a second embodiment of the invention illustrated in FIGS. 6 and 7. FIG. 6 is an enlarged fragmentary view similar to that illustrated in FIG. 2A but having a different configuration of the intermediate transition portion. This is identified in FIG. 6 at 24. Rather than a curvature in that direction, there is provided an equal thickness flattened portion having a planar surface illustrated at 25 in FIG. 6. This transition portion thus has a flat surface in a vertical direction and sweeps in an arc, in and out of the paper in FIG. 6, as illustrated by the cross-sectional view of FIG. 7. FIG. 6 also illustrates the aforementioned axes A, B and C. It is noted that the embodiment in FIG. 6 has the jewel surface mated more exactly with the transition portion 24.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A jewelry setting for supporting a jewel comprising a one-piece support member that includes a base portion having multiple sides, a plurality of elongated prongs with one extending from each respective side of the base portion, each said elongated prong including contiguous respective proximal biasing portion and distal retaining portion, each said proximal biasing portion extending integrally from a respective side of the base portion, each said retaining portion for capturing the jewel and having a longitudinal axis C that extends at an angle to a longitudinal axis of the proximal biasing portion, and wherein at least said proximal biasing portion has a width defined as an arcuate cross-section in a direction that is transverse to the longitudinal axis of the proximal biasing portion, wherein the proximal biasing portion has a length greater than a length of the distal retaining portion, and wherein the proximal biasing portion includes contiguous first and second biasing portions with the first biasing portion being more proximally arranged than the second biasing portion and the first biasing portion having a longitudinal axis A that is longer than a longitudinal axis B of the second biasing portion, and wherein each of the first and second biasing portions have their respective longitudinal axes disposed at an obtuse relative angle less than 180 degrees.

2. The jewelry setting of claim 1 wherein the angle between the respective longitudinal axes B and C is substantially a right angle, and the base portion has a bottom flat surface.

3. The jewelry setting of claim 1 wherein the arcuate cross-section is configured as a constant radius of curvature having the same radius across the entire width of the proximal biasing portion.

4. The jewelry setting of claim 3 wherein the distal retaining portion also has a width defined as an arcuate cross-section in a direction that is transverse to the longitudinal axis of the distal retaining portion.

5. The jewelry setting of claim 4 wherein each prong also includes an intermediate transition portion contiguous with and disposed between the respective biasing and retaining portions.

6. The jewelry setting of claim 5 wherein the entire length of the prong has a transverse arcuate cross-section.

7. The jewelry setting of claim 6 wherein the intermediate transition portion has an arcuate cross-section in a direction in line with the longitudinal axis of the proximal biasing portion.

8. The jewelry setting of claim 7 wherein the intermediate transition portion also has an arcuate cross-section in a direction transverse to the proximal biasing portion.

9. The jewelry setting of claim 1 wherein the distal retaining portion also has an arcuate cross-section in a direction that is transverse to the longitudinal axis of the distal retaining portion.

10. The jewelry setting of claim 9 wherein the arcuate cross-section is defined by a radius of curvature S having a center T.

11. The jewelry setting of claim 1 wherein the distal retaining portion also has a width defined as an arcuate cross-section in a direction that is transverse to the longitudinal axis of the distal retaining portion, and the arcuate cross-section is continuous from the proximal biasing portion to the distal retaining portion.

12. A jewelry setting for supporting a jewel comprising a one-piece support member that includes a base portion having multiple sides, a plurality of elongated prongs with one extending from each respective side of the base portion, each said elongated prong including contiguous respective proximal biasing portion and distal retaining portion, each said proximal biasing portion extending integrally from a respective side of the base portion, each said retaining portion for capturing the jewel and having a longitudinal axis C that extends at an angle to a longitudinal axis A of the proximal biasing portion, and wherein at least said proximal biasing portion has a width defined as an arcuate cross-section in a direction that is transverse to the longitudinal axis of the proximal biasing portion, wherein the proximal biasing portion has a length greater than a length of the distal retaining portion, and wherein the proximal biasing portion includes contiguous first and second biasing portions with the first biasing portion being more proximally arranged than the second biasing portion and the first biasing portion longitudinal axis A being longer than the second biasing portion longitudinal axis B, and wherein a width of each prong portion is less than a length of a respective prong portion, and wherein each of the first and second biasing portions have respective longitudinal axes that are disposed at an obtuse angle less than 180 degree.

13. A jewelry setting for supporting a jewel comprising a one-piece support member that includes a base portion having multiple sides, a plurality of elongated prongs with one extending from each respective side of the base portion, each said elongated prong including contiguous respective proximal biasing portion and distal retaining portion, each said proximal biasing portion extending integrally from a respective side of the base portion, each said retaining portion for capturing the jewel and having a longitudinal axis C that extends at an angle to a longitudinal axis of the proximal biasing portion, wherein said proximal biasing portion has a width defined as an arcuate cross-section in a direction that is transverse to the longitudinal axis of the proximal biasing portion, and wherein the proximal biasing portion includes contiguous first and second biasing portions with the first biasing portion being more proximally arranged than the second biasing portion and the first biasing portion longitudinal axis A being longer than the second biasing portion longitudinal axis B, and wherein the distal retaining portion also has a width defined as an arcuate cross-section in a direction that is transverse to the longitudinal axis of the distal retaining portion, and wherein the longitudinal axes A and B are non-coincident.

14. The jewelry setting of claim 13 wherein the arcuate cross-section is configured as a constant radius of curvature.

15. The jewelry setting of claim 14 wherein the constant radius of curvature has the same radius across an entire width of both the proximal biasing portion and the distal retaining portion.

* * * * *